United States Patent [19]

Rello et al.

[11] 4,319,850

[45] Mar. 16, 1982

[54] METHOD AND MEANS FOR STORING TYPING RIBBON

[75] Inventors: Michael J. Rello, Willow Grove; Barry R. Detwiler, Royersford, both of Pa.

[73] Assignee: Exxon Research & Engineering Co., Florham Park, N.J.

[21] Appl. No.: 61,875

[22] Filed: Jul. 30, 1979

[51] Int. Cl.[3] ..... B41J 35/00

[52] U.S. Cl. ..... 400/247; 400/208; 400/227

[58] Field of Search ..... 400/194–196.1, 400/208, 227–227.2, 228, 247, 248

[56] References Cited

U.S. PATENT DOCUMENTS

| | | | |
|---|---|---|---|
| 3,871,507 | 3/1975 | Perry et al. | 400/227 X |
| 4,034,935 | 7/1977 | Plaza et al. | 400/208 X |
| 4,132,485 | 1/1979 | Hess | 400/208 |

FOREIGN PATENT DOCUMENTS

| | | | |
|---|---|---|---|
| 1034662 | 7/1958 | Fed. Rep. of Germany | 400/227.1 |

OTHER PUBLICATIONS

"Elements of Mechanism", Schwamb et al., 6th Ed., 1947, paragraph 12–19, pp. 342 and 344.

*Primary Examiner*—Paul T. Sewell

*Attorney, Agent, or Firm*—Norman L. Norris; Kenneth R. Schaefer

[57] ABSTRACT

A method of respooling used typing ribbon of the type comprising an ink, a binder and a plastic substrate is disclosed wherein the substrate is stretched after the ribbon has been typed upon in a preferential direction to a degree such that the ribbon undergoes a preferential deformation whereby the ribbon may be more readily respooled prior to disposal. Preferably the stretching means comprises a profile shape formed as part of the ribbon guide system within a ribbon cartridge.

13 Claims, 14 Drawing Figures

METHOD AND MEANS FOR STORING TYPING RIBBON

FIELD OF THE INVENTION

This application relates to the storage of used typing ribbon pending disposal thereof. More particularly, this invention solves a problem found in the prior art in the field of typing wherein a typing ribbon is of the plastic substrate type which tends to be difficult to reel up after use.

BACKGROUND OF THE INVENTION

In recent years it has become increasingly common practice in the printer art, specifically including typewriters, to use inked ribbons for providing ink for printing purposes which comprise a plastic substrate having a layer of carbon and a binder disposed on one side thereof. Such ribbons are of several types; chief among these are the single-strike and the multiple-impression type ribbons. In the single-strike type ribbon, only so much ink is put on the ribbon as will permit the printing of a single character per unit area on the ribbon. In the multiple strike type, much more ink is used, so that fractions of several characters may be printed with each area of ribbon. Thus, upon each impact of a character element upon the ribbon, the ribbon advances some distance less than the width of the typical character. However, in both cases the ribbons are used but once from end to end and are then discarded. This is in contrast to the prior type of ribbon which was a fabric-backed ribbon and which had considerably more ink on it than do the present ribbons and could be reused several times. A second distinction between the prior fabric-type ribbons and the plastic-backed ribbons now commonly in use is that the fabric ribbons were not permanently deformed by the the impact of the character elements thereon, whereas the plastic ribbons now in use tend to be stretched beyond their elastic limit when impacted by a character element and therefore are deformed from an essentially flat, strip-like configuration into a bellied strip-like configuration. This can cause difficulties in the re-winding of the ribbon after use for storage prior to disposal. In particular, the plastic-backed ribbons are so thin, and so much ribbon is put into the typical ribbon cartridge in which these ribbons are supplied, and in which they are stored after use, that unless means are found whereby the ribbon can be very carefully and accurately wound upon a spool it will in many cases tend not to wind up properly and will instead jam up the cartridge, thus necessitating its replacement.

OBJECTS OF THE INVENTION

It is therefore an object of the present invention to provide an improved method whereby used plastic backed typing ribbon can be stored prior to its destruction.

A further object of the invention is to provide an improved method for winding used ribbon up prior to disposal whereby jamming of typwriter ribbon cartridges can be avoided.

Yet another object of the invention is to provide a typewriter ribbon cartridge which will not jam due to improper re-winding of used ribbon but which is nevertheless simple and inexpensive to construct.

Finally, an ultimate object of the invention is to provide an improved typewriter ribbon cartridge.

SUMMARY OF THE INVENTION

The above objects of the invention and needs of the art are satisfied in the present invention by the provision of ribbon stretching means, desirably within the cartridge, which stretch the substrate of the ribbon beyond its elastic limit, so as to permanently impart a desired shape thereto. This shape can, in turn, be used according to well known prior art principles to provide a stable re-winding operation.

BRIEF DESCRIPTION OF THE DRAWING

The invention will be better understood if reference is made to the accompanying drawing, in which.

DESCRIPTION OF THE PREFERRED EMBODIMENTS

Figure 1:
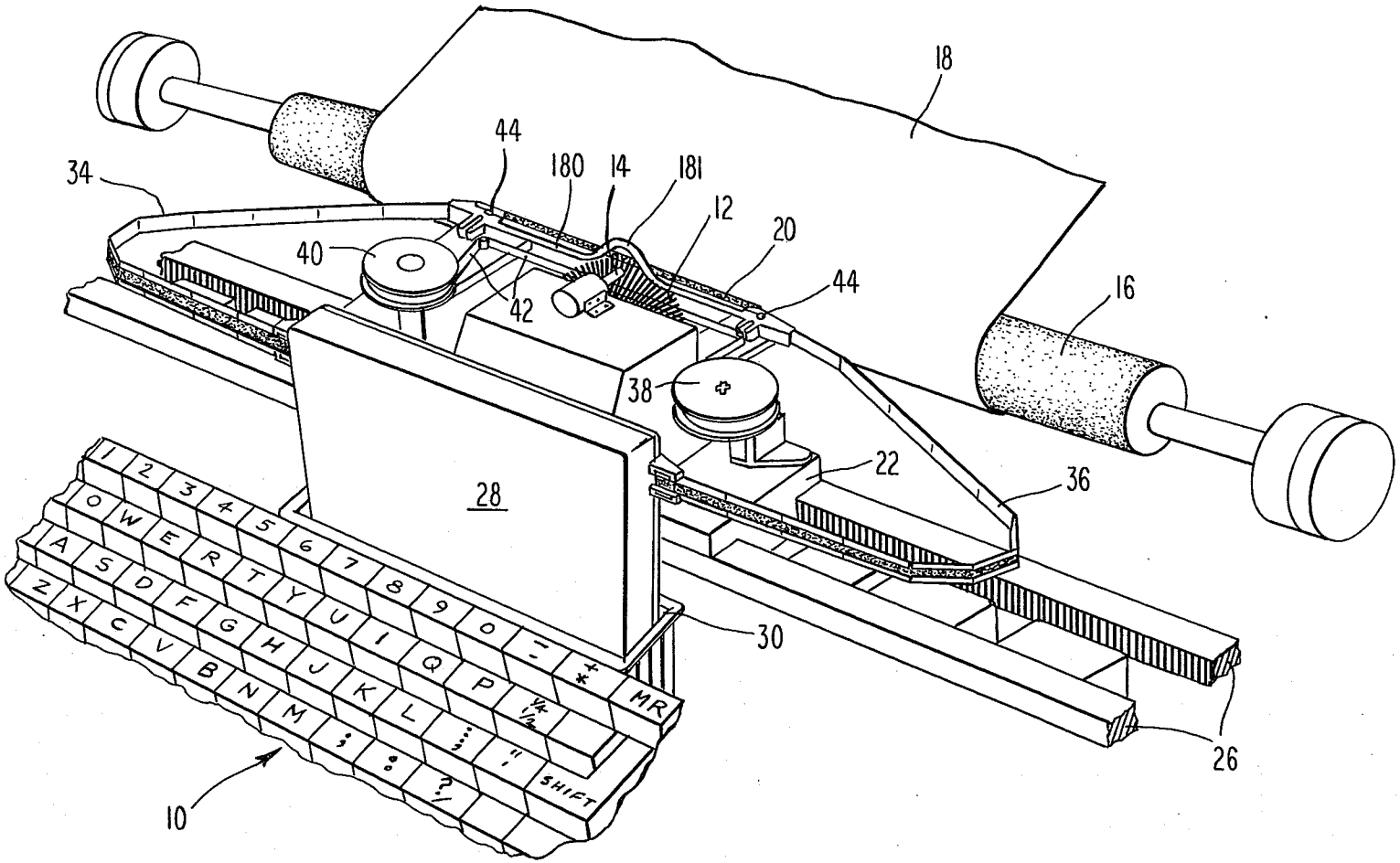
FIG. 1 shows a ribbon cartridge according to the invention in its intended environment, i.e. a typewriter.

Referring now to FIG. 1, the overall arrangement of a typewriter according to the present invention is shown. This typewriter comprises a keyboard 10 which controls the motion of a print wheel 12 which may comprise a plurality of spokes having character elements formed at their ends and adapted to be impacted by a hammer 14 in order to drive a selected character element against a platen 16 around which a sheet of paper 18 may be rolled. A print ribbon 20 is interposed between the character element 12 and the paper 18 so as to leave an inked impression corresponding to the character elements selected. It will be observed that in FIG. 1 the ribbon 20 is shown as being disposed somewhat below the print point defined by the position of the hammer 14. This is so that the operator of the typewriter can see what he or she has typed. In operation, the ribbon 20 is raised by lifter means (not shown) when the hammer 14 is about to impact the character element 12. The ribbon 20 is carried by locater means 180 which is provided with an uplifted portion 181 under which the hammer 14 and character element may pass on their way to the paper 18. The locator means 180 is mounted by means of posts 44 on a moving carriage 22 desirably driven by a linear stepper motor 26. The ribbon 20 is then passed through flexible leaders 34 and 36 which are connected in turn to a ribbon cartridge 28 which is mounted within a receptacle 30. In this way, when the carriage 22 moves back and forth with respect to the frame of the typewriter and the paper 18, the flexible leaders 34 and 36 permit the locating means 180 to move with the carriage 22 while the cartridge 28 remains fixed, the flexible leaders 34 and 36 providing the interconnection therebetween.

There may also be desirably mounted on carriage 22 an erase ribbon 42 which may be supplied from a first reel 38 and taken up by a second reel 40 and used to either overprint a letter struck in error or to remove it, depending on the type of ink supplied by the ribbon.

It will be observed that in FIG. 1 flexible leaders 34 and 36 comprise a series of comparatively short straight sections rather than a continuous curve. This is found to be a desirable method of manufacture of such flexible leaders.

Figure 2:
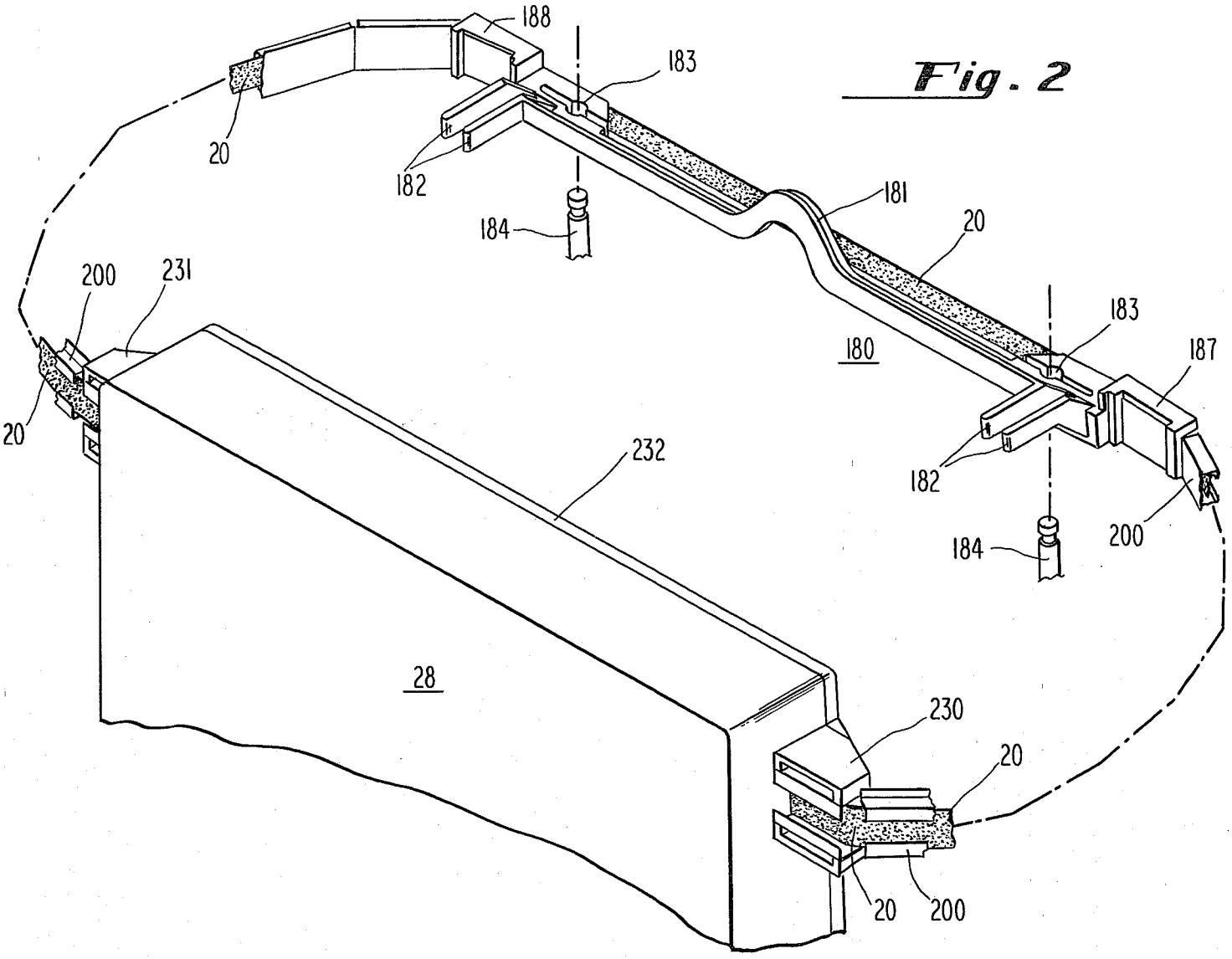
FIG. 2 shows an enlarged view of ribbon cartridge means according to the invention including ribbon locating means and ribbon guide means.

Referring now to FIG. 2 details of the cartridge 28 and ribbon locator 180 are shown. The cartridge 28 is connected to the flexible leader 200 by means of mounting structure 231 and 230. These are desirably mounted on the main section of the cartridge 28 so that the lid 232 of the cartridge 28 may be made as a simple part. Ribbon 20 is fed through first flexible leader 200 to locator 180 and returns by means of second flexible leader 200 back to cartridge 28.

Locator 180 comprises a central section spacing ends 188 and 187 apart. These ends are adapted to mate with corresponding pieces of leader 200. The ends 187 and 188 are provided with shaped notches 183 which engage posts 184 which are mounted on the carriage of the typewriter and are, as discussed above, lifted when typing is performed so as to interpose the ribbon 20 between a selected character element and paper 18. A raised central portion 181 of the locator 180 is provided so that the hammer 14 and character element 12 may pass therethrough on their way to impact the paper. Desirably, the ends of the locator 180 are provided with fingers 182 which may be operated by the operator when changing ribbons in order to open notches 183 so as to disengage from posts 184, for convenience in changing cartridges.

Figure 3:
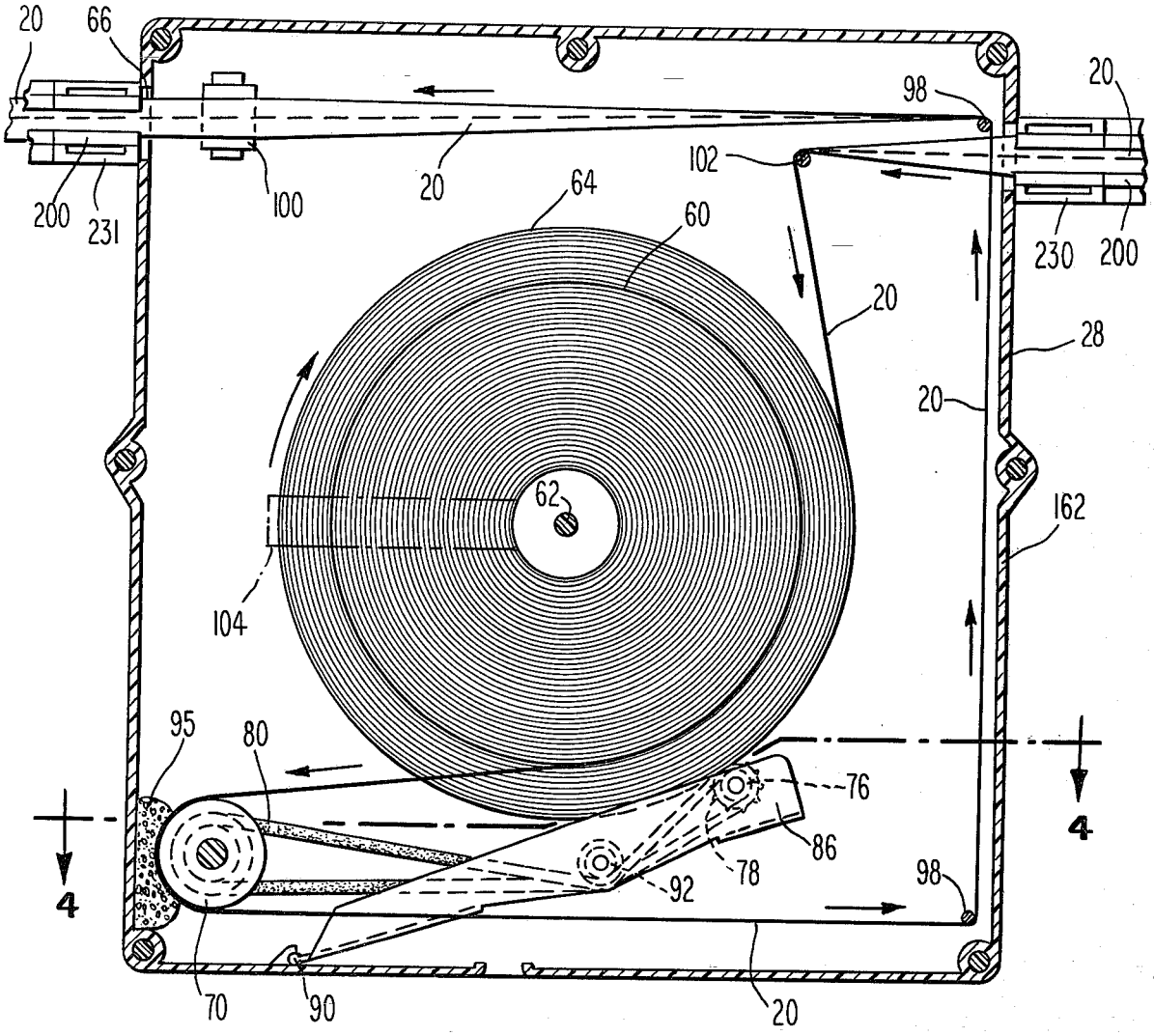
FIG. 3 shows an enlarged view of the interior of the ribbon cartridge.
Figure 4:
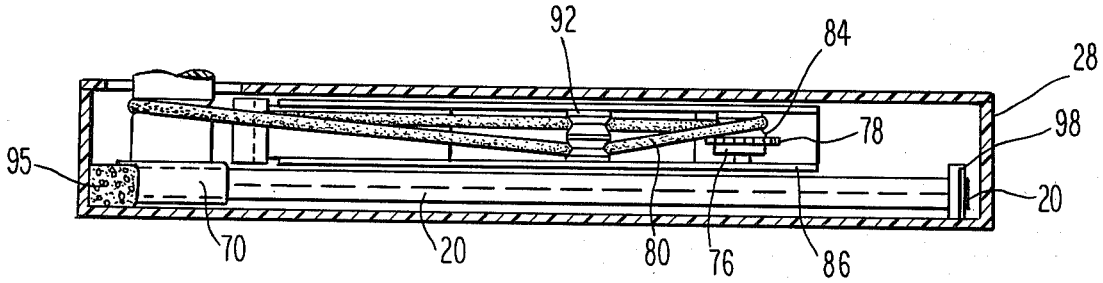
FIG. 4 shows a cross-section along the line 4—4 of FIG. 3.

Referring now to FIGS. 3 and 4, internal details of the cartridge 28 are shown. The ribbon 20 is shown being unwound from a supply reel 60 by means of a capstan 70 which is desirably driven by a stepper motor mounted on the typewriter (not shown). Ribbon 20 then passes around two guide posts 98, over a roller 100, and exits the cartridge 28 by means of leader mounting structure 231 and leader 200, thence to pass to the print point. After being typed upon, the ribbon 20 is returned again via leader 200 and leader mounting structure 230 over a post 102 and onto a take up reel 64. Said supply and take up reels 60 and 64, respectively, (which in a preferred embodiment are flangeless coils of ribbon) are mounted concentrically on a hub 62 and are both driven by means of the stepper motor, not shown, acting on capstan 70. However, while the capstan 70 directly pulls on the ribbon 20 to supply it, the take-up is driven by means of an intermediary O-ring 80 and a star wheel 76 which is provided with teeth 78 which engage the typed-upon ribbon as it is wound onto the take-up reel 64. Said O-ring 80 may desirably be passed over an intermediate pulley 92 which may be arranged so as to exert an inward tension (i.e a tension acting toward the hub 62) on an arm 86 pivoted at 90 on which the star wheel 76 is mounted so as to keep the star wheel in engagement with take-up reel 64. It has been found desirable by applicants to make the star wheel 76 by an integral molding process, whereby a plastic wheel is formed around a stamped metal star; in this way, an effective and unitary construction may be formed simply and inexpensively. It will be observed from FIG. 4 that the capstan 70 is shown as comprising a resilient band around its lower circumference which drives the inked ribbon. In some circumstances it is desirable to form this tire integrally with the capstan 70 by means of an integral molding process. In other cases, a resilient band of the proper size may be slipped over the capstan 70.

Further details of the leader 200 are the subject of co-pending application Ser. No. 061,880 filed July 30, 1979; a foam pressure device 95, which may be used to urge ribbon 20 into engagement with capstan 70, is more fully discussed in co-pending application Ser. No. 061,879 filed July 30, 1979.

Figure 5A:
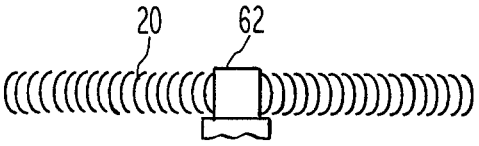
FIGS. 5*a* and 5*b* show alternate ways of winding a ribbon upon a spool.
Figure 5B:
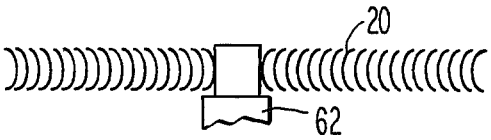

Referring now to FIGS. 5*a* and *b*, there are shown two alternative schemes according to which curved ribbon 20 may be wound upon a spool 62. In FIG. 5*a* the ribbon is shown curving outward from the spool in a convex fashion and in FIG. 5*b* it curves inward in a concave fashion. Both configurations offer certain advantages over spooling of flat ribbons. However, the configuration shown in FIG. 5*a* generally preferred. This is because, as has been known in the prior art for many years, providing a crown on a flangeless spool generally allows any belt or tape being wrapped thereon to track more accurately with respect to the center of the spool. In this case, of course, prior layers of ribbon are themselves the crown. However, the spool 62 may be provided with a crown as well in order to help the crown of the ribbon begin. The reason why a crowned spool tends to cause the strapping wrapped upon it to be centered is because the stresses on the two sides of the strip about the crown are thereby equalized. This is discussed in, for example, paragraph 12–19 of "Elements of Mechanism", Schwamb et al, 1947.

Figure 6A:
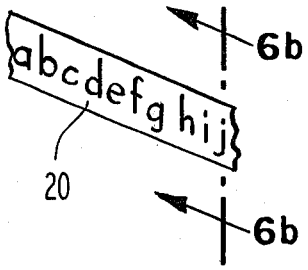
FIGS. 6*a* and 6*b* show the deformation experienced by plastic backed ribbon after typing.
Figure 6B:
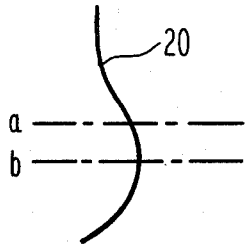
Figure 7:
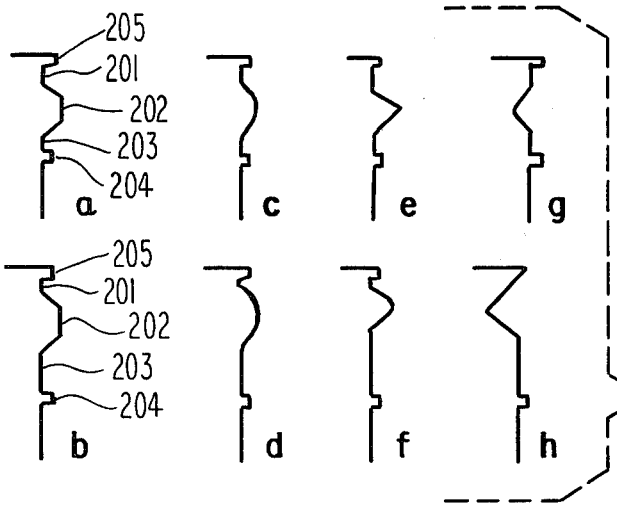
FIGS. 7*a*–7*h* show various profile shapes useful in the practice of the invention.
Figure 8:
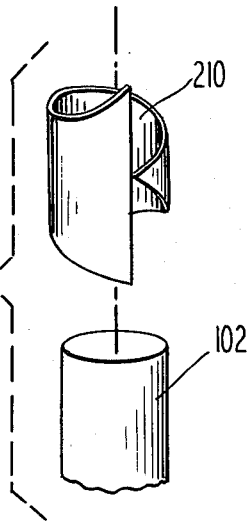
FIG. 8 shows one possible assembly of a deforming means according to the invention.

Referring now to FIGS. 6*a* and 6*b*, there is shown in FIG. 6*a* a ribbon 20 on which letters have been typed causing permanent deformation of the ribbon 20 due to stretching of the ribbon beyond its elastic limit in the area impacted by the character elements. It will be observed that most of the typing, and hence most of the deformation imparted to the ribbon or tape 20, is below the center line of the tape 20; as shown in FIG. 6*b*, which is a cross-section taken along the line 6*b*—6*b* of FIG. 6*a*, the tape 20 is most deformed at a point B which is below the center line A. Hence, if this is the shape of the crown provided while winding up used tape 20, the tape 20 will tend to wind unevenly. Therefore, it is desirable that the the tape 20 be further stretched in order to provide a more even crown. Alternatively, of course, the tape 20 could be stretched in such a way as to equalize the crown caused by typing by providing stretch to the remainder of the ribbon 20, thus flattening the tape 20 out, but this would be difficult to do and in addition would yield at best a flat tape, which, as discussed above, is not as easy to wind evenly as is a crowned tape. Therefore, in FIG. 7 there are shown various profiles of stretching means over which the ribbon may be stretched beyond its elastic limit so as to provide a more even crown. FIGS. 7*a* and 7*b* correspond as do 7*c* and 7*d*, 7*e* and 7*f*, and 7*g* and 7*h*. In the first of each of the pairs mentioned, the stretching means is shown with a centered stretching portion whereas in the second of each pair the stretching means is shown off center with respect to the ribbon whereby the crown imparted by typing is evened out by the addition of a second crown. Thus, for example, comparing FIGS. *7a* and *7b*, there is provided a stretching profile consisting of two flanges 205 and 204 within which the tape 20 rides, and a raised area 202, which is centered in FIG. *7a* between the flanges 205 and 204, but is located towards the upper flange 205 in FIG. *7b*. Each profile is provided with areas between the flanges 204 and 205 and the raised sections 202, 201 and 203. Areas 201 and 203 are equal in FIG. *7a* because that profile is designed to impart a symmetrical stretching to the ribbon; while in FIG. *7b*, area 201 is almost nonexistent and area 203 is quite large so that the tape will be stretched by this profile in an area ordinarily not stretched by typing so as to provide an overall symmetrically stretched tape. Similar reasoning applies to FIGS. *7c* and *7d*, *7e* and *7f*, and *7g* and *7h*. In FIGS. *7c* and *7d* it will be noted that a rounded crown will be imparted to the ribbon; in FIGS. *7e* and *7f* a sharp point at the apex of a triangular shape is used to provide a local stretch beyond the elastic limit of the ribbon; while in FIGS. *7g* and *7h* a reverse profile is used in the case where the tape is either designed to be stretched in areas not stretched before or where the direction of the tape's passing over the stretching means is reversed. Regardless of the particular configuration of the stretching profile chosen, it may advantageously be installed in the tape cartridge shown in FIG. 3 at, for example, the region of guidepost 102.

Figure 10:
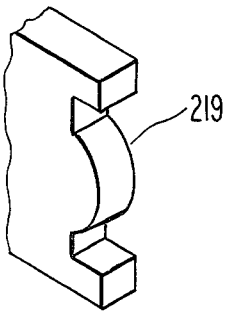
FIGS. 9, 10 and 11 show alternative deformation means for stretching a ribbon beyond its elastic limit.
Figure 9:
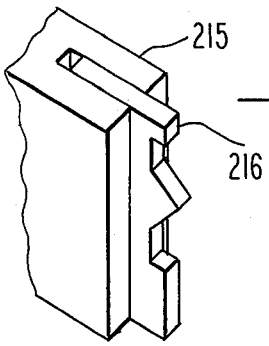
Figure 11:
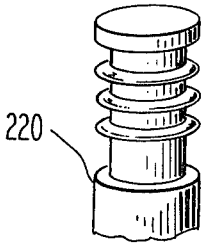
Figure 12:
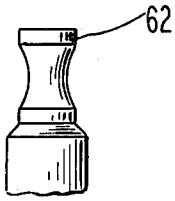
FIG. 12 shows a spool configuration which may be useful in the rewind spool of the cartridge according to the present invention.

Several different methods of providing stretching means are shown in FIGS. 8–11. For example, in FIG. 8 a triangular piece of sheet metal 210 rolled to roughly approximate a cylinder is slipped directly over guidepost 102 in such a way that the point of the sheet metal stretching means is contacted by the ribbon as it passes around guidepost 102. It has been found that a sharp point of this kind provides a very effective localization of stress which tends to stretch the ribbon beyond its elastic limit so that it does not recover its original shape once past the guidepost 102. FIG 9 shows a second means whereby a profile 216, which may be cut out of sheet metal, is inserted in a slot in a part of the cartridge 215 molded to accept such profile pieces. FIG. 10 shows a profile 219, preferably molded integrally with the cartridge 28, and having a profile shape molded therein. FIG. 11 shows an upstanding post 220 which may be generally circular in cross section and have a stretching profile cut therein and which might, for example, be mounted in a boss formed in the ribbon cartridge 28. Finally, FIG. 12 shows a hub 62 which may be substituted for the simple cylindrical hub 62 shown in FIGS. *5a* and *5b*. The hub 62 shown in FIG. 12, it will be noted, is concave, thus providing an area for the deformation caused by typing to "go" so that it will tend to wind onto the spool more evenly.

It will be appreciated that there has been disclosed a method whereby the natural tendency of a plastic backed tape to be crowned by the impact of a character element thereon can be used, given appropriate assistance, to help the used ribbon be spooled up prior to disposal. Specifically, it has been shown how, by simply passing the ribbon in its path over a deformation means, the ribbon can be stretched beyond its elastic limit so as to take a shape which will assist it in being evenly spooled. In this connection, it will be apparent to those skilled in the art that the shaping means must be such as to stretch the plastic substrate of the ribbon beyond its elastic limit; that is, beyond the point at which permanent deformation takes place. Clearly, if the material is not stretched to this point, it will simply return to its original shape after contact with the shaping means has ended. Further, it will be clear that sufficient tension must be provided to pull the substrate over the shaping means with adequate force to stretch. Therefore, it will be apparent that the force exerted on the tape and the shape of the stretching means both have relevance. For example, if the shaping means comprises a very sharp point, then less force would be required than otherwise; of course, in such a circumstance, less of the tape will be deformed as well. Finally, it will be appreciated that the method of the invention will be more readily adapted to those tapes wherein the elastic limit of the plastic substrates is relatively low and where its elastic limit is relatively different from its ultimate tensile strength. For example, certain tapes are made having a substrate of a material known as "Mylar", the elastic limit of which is very close to its ultimate tensile strength. Therefore, if such a "Mylar" tape were to be stretched by the method disclosed in the invention, it would be difficult to stretch the material adequately that it were permanently deformed, but not so much that it tended to break.

Further, it will be apparent that the method of the invention has utility beyond typing ribbons and printing machines, but indeed is useful in any case where a stretchable tape is to be spooled after being acted upon at a point of use. Likewise, it is clear tht such a ribbon might consist only of a plastic substrate material, i.e., might not include ink; and it will be appreciated that the stretching means need not be within the cartridge, but might in some cases be usefully located external thereby.

It will appear, therefore, to those skilled in the art that there are numerous modifications and improvements which can be effected upon the apparatus of the invention without departing from its essential scope, which is more properly defined by the following claims.

What is claimed is :

1. In printing apparatus of the type wherein ribbon is passed along a path from a first spool, traversed past a print location where it is impacted for printing on a print medium and then spooled upon a second spool prior to disposal, the tape being of the type which is stretched beyond its elastic limit by being impacted for printing, the improvement which comprises:

providing means located between said print location and said second spool for preferentially stretching a part of said ribbon to a degree such that its elastic limit is exceeded, whereby material takes on a permanent crown providing ease of spooling.

2. Apparatus according to claim 1 wherein the crown imparted to said material is asymmetrical with respect to the centerline of said tape.

3. Apparatus according to claim 1, wherein the crown imparted to said material is symmetrical with respect to the centerline of said tape.

4. Apparatus according to claim 1 wherein said means for preferentially stretching said ribbon comprises a shape over which said ribbon is passed.

5. Apparatus according to claim 4 including a ribbon cartridge housing said first spool and said second spool wherein said shape comprises a triangular piece of sheet metal, having been rolled to a substantially cylindrical shape, and mounted in said cartridge so that said tape is passed directly over a corner of said triangle.

6. In a ribbon system of the type where a ribbon is unspooled from a first spool, acted upon and rewound onto a second spool, the improvement which comprises providing means for deforming the substrate of said ribbon after having been acted upon, such that said ribbon takes on a permanent deformation and is more readily respooled after use, said means for deforming comprising a sharp corner formed by the apex of a triangular piece of sheet metal.

7. In a method of printing comprising the steps of selecting a character element, juxtaposing said character element, an inked ribbon, a print receiving medium and a platen, impacting said character element so as to cause said element to press said inked ribbon against said paper, said paper being backed by said platen, and advancing said ribbon to a next position, wherein said ribbon is advanced at every impact stroke, and is wound on a spool after typing thereon, the improvement which comprises:

passing said ribbon, after it has been typed upon, over deforming means whereby at least a portion thereof is preferentially stretched beyond its elastic limit, and a crown is formed in said ribbon allowing more ready respooling thereof.

8. The method according to either of claim 7, wherein said crown is formed symmetrically with respect to the longitudinal center line of said ribbon.

9. The method according to either of claim 7, wherein said crown is formed asymmetrically with respect to the longitudinal center line of the ribbon.

10. The method according to claim 7, wherein said ribbon is passed over said deforming means under tension.

11. The method according to claim 7, wherein said deforming means comprises a sharp corner at a piece of sheet metal.

12. The method according to claim 11, wherein said corner is one apex of a triangle formed of said sheet metal.

13. The method of claim 12 wherein the step of permanently deforming includes:

passing the ribbon over a deforming shape; and maintaining the ribbon under tension during deforming.

* * * * *